US005562356A

United States Patent [19]

Hilbert

[11] Patent Number: 5,562,356

[45] Date of Patent: Oct. 8, 1996

[54] LIQUID SUBSTANCE RECEPTACLE PROVIDED WITH AN APPLICATOR

[76] Inventor: Raymond Hilbert, 1, Place de la Gare, 78590 Noisy Le Roi, France

[21] Appl. No.: 244,131

[22] PCT Filed: Nov. 20, 1994

[86] PCT No.: PCT/FR91/00918

§ 371 Date: May 18, 1994

§ 102(e) Date: May 18, 1994

[87] PCT Pub. No.: WO93/10016

PCT Pub. Date: May 27, 1993

[51] Int. Cl.[6] ..... B05C 17/00

[52] U.S. Cl. ..... 401/264; 401/262

[58] Field of Search ..... 401/264, 262

[56] References Cited

U.S. PATENT DOCUMENTS

| | | | |
|---|---|---|---|
| 378,744 | 2/1888 | Underwood | 401/264 |
| 403,566 | 5/1889 | Underwood | 401/264 |
| 551,524 | 12/1895 | Bouton | 401/264 |
| 567,704 | 9/1896 | Clark | 401/264 |
| 651,420 | 6/1900 | Haglock | 401/264 |
| 1,735,073 | 11/1929 | Carpenter | 401/264 |
| 2,102,749 | 12/1937 | Salvesen | 401/264 |

FOREIGN PATENT DOCUMENTS

| | | | |
|---|---|---|---|
| 1119242 | 6/1956 | France | 401/264 |
| 1185116 | 7/1959 | France . | |
| 1351565 | 12/1963 | France . | |
| 2596984 | 10/1987 | France . | |
| 235330 | 6/1925 | United Kingdom | 401/264 |
| 451015 | 8/1936 | United Kingdom . | |
| 2187950 | 9/1987 | United Kingdom . | |

*Primary Examiner*—Steven A. Bratlie
*Attorney, Agent, or Firm*—Robbins, Berliner & Carson

[57] ABSTRACT

A container for a substance that is liquid, viscous, or semi-liquid, is provided with an applicator comprising a cap (22) having an outlet slot (32) in which an elastically deformable tongue (20) is engaged, the tongue extending one of the walls of the container and being capable of passing by elastic deformation from a rest position in which it closes the outlet slot (32) to a working position in which it opens a portion of the slot.

5 Claims, 2 Drawing Sheets

LIQUID SUBSTANCE RECEPTACLE PROVIDED WITH AN APPLICATOR

The invention relates to a container for a substance that is liquid, viscous, or semi-liquid, the container being provided with an applicator having an elastically deformable tongue enabling a layer of the substance to be spread on any surface.

The invention is particularly intended for applying a depilatory wax to the skin, but it may also be used for applying a layer of glue or any other substance that is liquid, viscous, or semi-liquid at ambient temperature or at a temperature slightly above ambient temperature.

A container is known (e.g. from patent GB 451 015) having a closure cap that includes a rubber tongue which is normally pressed against an edge of the container to close it and which can be separated therefrom by bending in order to enable the substance contained in the container to escape, thereby simultaneously forming means for spreading the substance.

Nevertheless, with that known device it is difficult to control accurately the quantity of substance that leaves the container, since the dimensions of the outlet orifice depend on how much the tongue bends, so they can vary rather widely.

The invention serves in particular to avoid that drawback.

The invention thus provides a container for a substance that is liquid, viscous, or semi-liquid, the container being provided with an applicator comprising an elastically deformable tongue having a free end designed to be applied against a surface on which the substance is to be deposited for the purpose of spreading the substance on said surface, the container being characterized in that said tongue is disposed inside an outlet slot for the substance and is displaceable by elastic deformation from a rest position in which it closes said slot to a working position in which it opens a portion of said slot and enables the substance to escape, said rest and working positions of the tongue both being defined positively by the tongue bearing against fixed abutments.

This type of applicator is advantageous in that it automatically closes the outlet slot for the substance when it is at rest. Applying the tongue against a surface causes the tongue to deform elastically, thereby opening the outlet slot for the substance in controlled manner. The outlet section for the substance is thus determined accurately, thereby making it possible to deposit and spread a layer of substance having predetermined thickness over a surface. In addition, it suffices to move the applicator away from the surface on which the substance is being deposited to cause the tongue to return automatically to its rest position where it closes the outlet slot for the substance.

According to another characteristic of the invention, the abutments are the edges of the outlet slot for the substance.

The slot may be of greater or lesser width and length as a function of the type of substance to be spread.

In a first embodiment of the invention, the tongue is integrally molded with the container and it extends from the edge of an open end of the container inside a cap mounted on said open end of the container, and having the outlet slot for the substance, with the end of the tongue going through the slot.

In this case, the container and its applicator are constituted by two molded parts, which are merely engaged one in the other.

In another embodiment of the invention, the tongue is integrally molded with a closure piece for the open end of the container, and when in its rest position it presses against an edge of said opening, and when in its working position it presses against a fixed abutment of said closure piece.

In this case also, the container and its applicator are constituted by two molded parts, which are engaged one in the other.

In a variant, said closure piece may comprise two elastically deformable tongues of the above-specified type which are connected to each other in a V-shape or a W-shape, and two abutments defining the working positions of the two tongues.

In addition, the closure piece comprises a fixed central portion whose two opposite ends are provided with projections engaging in grooves in two opposite walls of the container, thereby holding said piece in position and preventing it from rotating relative to the container.

No special tool or means is required for assembling together the container and its applicator.

The invention will be better understood and other characteristic, details, and advantages thereof will appear more clearly on reading the following description given by way of example and made with reference to the accompanying drawings, in which.

Reference is made initially to FIGS. 1 to 4 which show a first embodiment of the invention.

Figure 1:
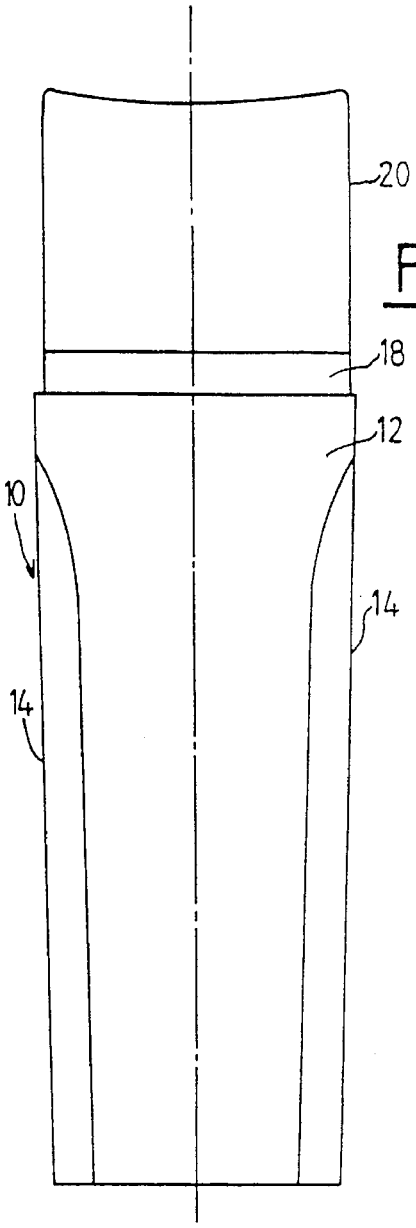
FIGS. 1 and 2 are a face view and a side view respectively of a container for a substance that is liquid, viscous or semi-liquid.
Figure 2:
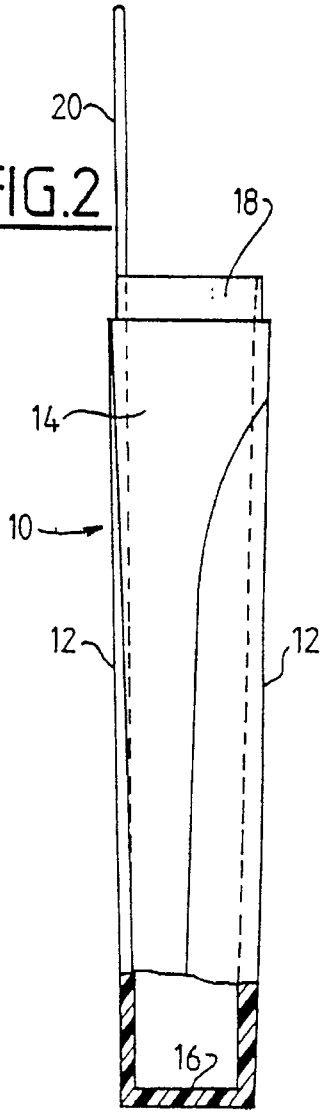

The container 10 shown in FIGS. 1 and 2 is a one-piece molding of plastics material and is substantially in the form of a rectangular parallelepiped. It essentially comprises two opposite and parallel large walls 12 interconnected by two small walls 14 that are perpendicular thereto. The bottom end of the container 10 is closed by a bottom 16 while its top end is opened and is defined by a peripheral rim 18 which is set back a little from the outside faces of the walls 12 and 14 of the container.

On one of its large sides, the rim 18 extends upwards, i.e. away from the bottom 16, in the form of an elastically deformable tongue 20 which is substantially rectangular in shape, being of relatively small thickness so as to be capable of presenting a degree of flexibility, and extending in line with the corresponding wall 12 of the container.

Figure 3:
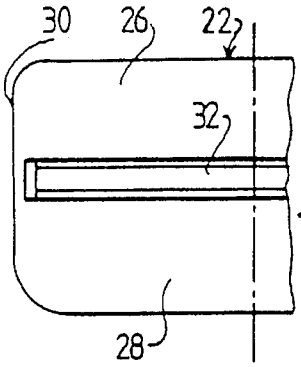
FIG. 3 is a half-view in plan of an applicator of the invention.
Figure 4:
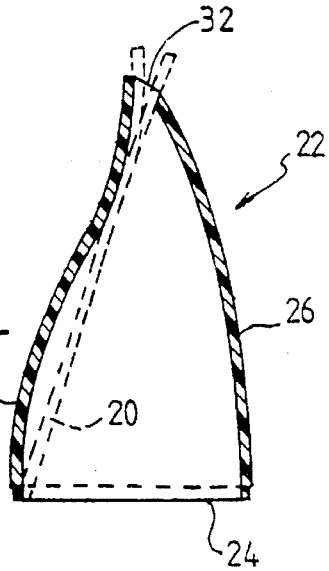
FIG. 4 is a vertical section through the applicator.

The top portion of the container 10 comprising the tongue 20 and the rim 18 is intended to be covered by a cap 22 that is molded out of plastics material and that is shown in FIGS. 3 and 4 (at a scale that is slightly different from that of the container).

The cap 22 has a base or bottom portion 24 of substantially rectangular outline suitable for fitting onto the rim 18 of the container. It also has a large wall 26 having a convex curving shape facing a wall 28 having both convex and concave curvature, being convex starting from the base 24 and becoming concave at its top end. These two walls 26 and 28 are connected together by two opposite side walls 30 that are substantially plane.

The top portion of the cap 22 has an outlet slot 32 for the substance, with the outline of the slot being substantially rectangular, being defined by the top edges of the walls 26, 28, and 30.

As can be seen in FIG. 4, the top edge of the convex wall 26 is at a level that is slightly lower than the level of the top edge of the opposite wall 28, such that the slot 32 extends in an oblique plane.

The cap 22 is mounted on the top portion of the container 10 so that the tongue 20 extends inside the cap in the position shown in dashed lines in FIG. 4. In this position, the tongue 20 is flexed and its top portion bears against the inside face of the concave portion of the wall 28 and then against the top edge of the opposite wall 26, thereby closing the outlet slot 32 in sealed manner.

To use the substance contained in the container 10, it suffices to turn the container upsidedown, so that the cap 22 is then at the bottom of the assembly, and then to apply the free end of the tongue 20 against the surface on which the substance is to be deposited. Because of the pressure of its free end against the surface in question, the tongue 20 moves away by elastic deformation from the edge of the convex wall 26 of the cap, thereby opening the outlet slot 32 and enabling substance to pass therethrough, with the substance flowing out under gravity.

The free end of the tongue 20 projects from the cap 22 and forms a spatula for spreading the substance. As soon as the end of the tongue is moved away from the surface on which substance has been deposited, the tongue automatically returns to its position closing the outlet slot 32.

When the free end of the tongue 20 is pressed against the inside face of the top edge of the wall 28 of the cap, the outlet section for the substance is defined accurately and can be made to correspond to a predetermined flow rate for the substance.

When the substance is a fluid depilatory wax, the outlet section for the substance has a width of about one millimeter and the tongue enables a layer of wax to be spread on the skin with a thickness of a few tenths of a millimeter, as a function of the type of wax, which thickness is determined to within 0.01 mm.

Another embodiment of the invention is shown in FIGS. 5 to 8.

Figure 5:
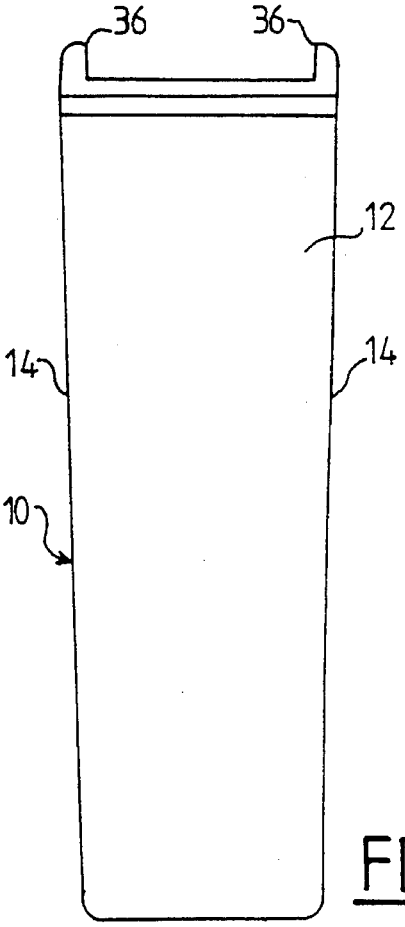
FIGS. 5 and 6 are a face view and a side view respectively of a variant embodiment of the container.
Figure 6:
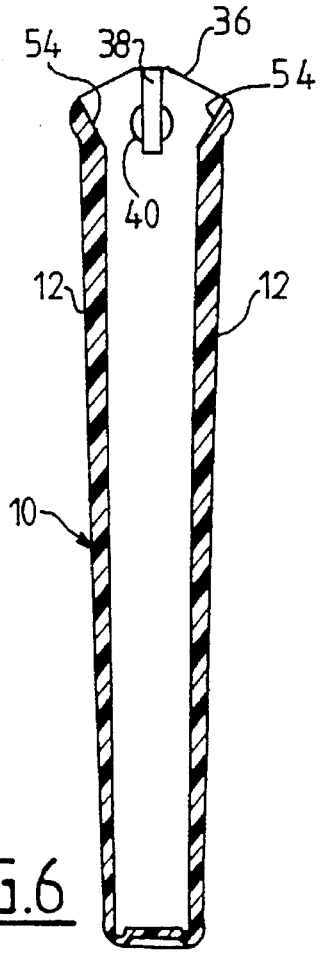

The container 10 in FIGS. 5 and 6 differs from that in FIGS. 1 and 2 in that it is not integrally molded with the elastically deformable tongue. At the open top end of the container 10, the two large walls 12 of the container flare outwardly, while the top edges 36 of the small side walls 14 are dome- or roof-shaped. Vertical grooves 38 are hollowed out in the inside faces of the side walls 14 running down a certain distance from their top edges 36. Each groove 38 opens out into a wider cavity 40, e.g. a circular cavity.

Figure 7:
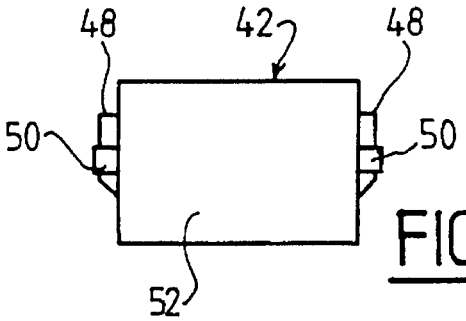
FIG. 7 is a face view of an applicator for mounting on the container.
Figure 8:
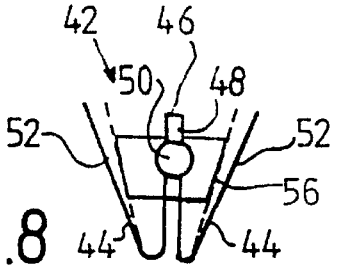
FIG. 8 is a side view of said applicator.

The container 10 is associated with a closure part 42 that is shown in FIGS. 7 and 8, and that is mounted by snap-fastening to the open top end of the container 10.

In the example shown, the closure part 42 is essentially constituted by two pairs 44 of mutually-sloping surfaces placed back-to-back and thus substantially forming a W-shape. The central portion 46 of the part 42 includes projections at its ends each constituted by a vertical rib 48 for engaging in a top end groove 38 of the container 10, together with a cylindrical stud 50 for engaging in the cavity 40 in the top portion of the container. The part 42 is resiliently snap-fastened to the top end of the container and is then held in position and prevented from rotating.

The two free walls 52 of the pairs 44 then press elastically against the inside faces 54 of the flared end portions of the large walls 12 of the container, thereby closing the open end of the container 10 in sealed manner. These walls 52 project beyond the top end edges of the container and play the same role as the elastically deformable tongue 20 in the first embodiment.

The central portion 46 of the part 42 also includes two symmetrical abutments 56 facing its free walls 52 and against which the free walls 52 press when they are in use, thereby defining together with the faces 54 two outlet slots for the substance.

As described above, it suffices merely to turn the container upsidedown and press the free end of a wall 52 against a surface to move said wall away from the above-mentioned inside face 54 at the top end of the container and press it against the abutment 56, thereby allowing the substance to escape through the resulting slot at a determined flow rate, and enabling a layer of substance to be spread to a determined thickness.

In the rest position, the wall 52 presses elastically against the inside face 54 of the top edge of the container and prevents the substance escaping.

Naturally, a closure piece 42 for the top end of the container could be formed having only one elastically deformable wall or tongue 52, and having only one abutment 56 associated with said wall 52.

In both of the embodiments described above, the substance can flow out from the container solely under gravity, or else as a result of pressure being exerted by the user on the walls of the container.

The invention is applicable to substances that are usable at ambient temperature or after being heated.

I claim:

1. A container for a substance which is liquid or viscous, the container comprising an open end, a cap mounted on said open end and provided with an outlet slot for the substance, the container further comprising an elastically deformable tongue extending through the outlet slot and having a free end designed for spreading the substance, said tongue being integrally molded with an edge of the open end of the container and being elastically deformable between a rest position in which it closes said slot and a working position in which it opens a portion of said slot and enables the substance to escape, said rest and working positions of the tongue being defined positively by the tongue bearing against opposite edges of the outlet slot.

2. A container according to claim 1, wherein the outlet slot is defined by two opposite walls of the cap, said tongue being elastically applied in sealed manner against said opposite walls in its rest position.

3. A container for a substance which is liquid or viscous, the container comprising an open end, a cap mounted on said open end and provided with at least one elastically deformable tongue integrally molded with the cap, said tongue having a free end designed for spreading the substance and being elastically deformable between a rest position in which it closes said open end and a working position in which it opens a portion of said open end and enables the substance to escape, said rest and working positions being defined positively by the tongue bearing against an edge of the open end and a fixed abutment of said cap, respectively.

4. A container according to claim 3, wherein the cap comprises two symmetrically and elastically deformable tongues which are applied on opposite edges of the open end of the container in their rest positions and on two symmetrical abutments on the cap in their working positions.

5. A container according to claim 3, wherein the cap is mounted on the open end of the container by resilient snap-fastening, the cap comprising a central portion having opposite ends which are engaged in grooves formed in two opposite walls of the container.

* * * * *